US008264443B2

(12) United States Patent
Lee et al.

(10) Patent No.: US 8,264,443 B2
(45) Date of Patent: Sep. 11, 2012

(54) RIPPLE PREVENTING GATE DRIVING CIRCUIT AND DISPLAY APPARATUS HAVING THE SAME

(75) Inventors: Hong-Woo Lee, Cheonan-si (KR); Hyeon-Hwan Kim, Cheonan-si (KR); Byeong-Jae Ahn, Suwon-si (KR); Sun-Hyung Kim, Seoul (KR); Sung-Man Kim, Seoul (KR); Bong-Jun Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 1016 days.

(21) Appl. No.: 12/241,880

(22) Filed: Sep. 30, 2008

(65) Prior Publication Data

US 2009/0189677 A1 Jul. 30, 2009

(30) Foreign Application Priority Data

Jan. 25, 2008 (KR) ..... 10-2008-0007964

(51) Int. Cl.
*G09G 3/36* (2006.01)

(52) U.S. Cl. ..... 345/100

(58) Field of Classification Search ..... 345/100
See application file for complete search history.

(56) References Cited

U.S. PATENT DOCUMENTS

| | | | | |
|---|---|---|---|---|
| 5,410,583 | A * | 4/1995 | Weisbrod et al. | 377/75 |
| 5,434,899 | A * | 7/1995 | Huq et al. | 377/78 |
| 5,859,630 | A * | 1/1999 | Huq | 345/100 |
| 2007/0127620 | A1 * | 6/2007 | Moon et al. | 377/64 |
| 2008/0001904 | A1 * | 1/2008 | Kim et al. | 345/100 |

* cited by examiner

*Primary Examiner* — Chanh Nguyen
*Assistant Examiner* — John Kirkpatrick
(74) *Attorney, Agent, or Firm* — Cantor Colburn LLP

(57) ABSTRACT

A gate driving circuit includes stages, the stages being cascaded and each including: a pull-up part which pulls up a gate voltage to a clock signal during a horizontal scanning period (1H); a carry part which pulls up a carry voltage to the clock signal during the horizontal scanning period (1H); a pull-up driving part connected to a control terminal (Q-node) common to the carry part and the pull-up part and which receives a previous carry voltage from a first previous stage to turn on the pull-up part and the carry part; and a ripple preventing part which prevents a ripple generated at a previous Q-node of a second previous stage based on a ripple generated at the Q-node of the carry part and the pull-up part.

18 Claims, 5 Drawing Sheets

RIPPLE PREVENTING GATE DRIVING CIRCUIT AND DISPLAY APPARATUS HAVING THE SAME

This application claims priority to Korean Patent Application No. 2008-07964, filed on Jan. 25, 2008, and all the benefits accruing therefrom under 35 U.S.C. §119, the contents of which in its entirety are herein incorporated by reference.

BACKGROUND OF THE INVENTION

1. Field of the Invention

The present invention relates to a gate driving circuit and a display apparatus including the gate driving circuit. More particularly, the present invention relates to a gate driving circuit which prevents a drive malfunction thereof and a display apparatus including the gate driving circuit.

2. Description of the Related Art

In general, a liquid crystal display includes a liquid crystal display panel to display a desired image thereon. The liquid crystal display panel typically includes a lower substrate, an upper substrate facing the lower substrate and a liquid crystal layer interposed between the lower substrate and the upper substrate.

The liquid crystal display panel further includes a plurality of gate lines, a plurality of data lines and a plurality of pixels, each of which is connected to a corresponding gate line of the plurality of gate lines and a corresponding data line of the plurality of data lines. A gate driving circuit which sequentially outputs a gate signal to the gate lines is directly formed on the liquid crystal display panel through a thin film process.

The gate driving circuit typically includes a shift register including a plurality of stages, and individual stages of the plurality of stages are each connected one after another, e.g., are cascaded. Each stage includes transistors and capacitors.

However, when the gate driving circuit is driven in a high, e.g., above normal, temperature environment, a threshold voltage of the transistors in each stage decreases. Thus, when a noise signal having a higher voltage level than the threshold voltage (which is lowered in the high temperature environment) is applied to a gate electrode of the transistors, the transistors are unintentionally turned on. In particular, when the noise signal is applied to gate electrodes of transistors connected to an output terminal of each stage, the transistors connected to the output terminals are inadvertently turned on during a turn-off period of the transistors. As a result, a gate voltage having an abnormal state is provided to the liquid crystal display panel through the output terminal, and the liquid crystal display panel thereby displays an abnormal image, e.g., an undesired image, in response to the gate voltage having the abnormal state. Further, the noise signal applied to a gate node of transistor connected to output terminal of each stage controls an operation of a next stage, since the stages of the shift register are cascaded. Therefore, the drive malfunction which occurs in a given stage causes a drive malfunction in adjacent cascaded stages, thereby further causing display malfunctions of the liquid crystal display.

Thus, it is desired to develop a gate driving circuit capable of preventing the abovementioned drive malfunction when operating in a high temperature operating environment, and a liquid crystal display having the same.

BRIEF SUMMARY OF THE INVENTION

The present invention provides a gate driving circuit which prevents a drive malfunction under a high temperature operating environment.

The present invention also provides a display apparatus including the gate driving circuit.

According to an exemplary embodiment of the present invention, a gate driving circuit includes stages which are cascaded with each other. Each of the stages includes a pull-up part, a carry part, a pull-up driving part and a ripple preventing part.

The pull-up part pulls up a gate voltage to a clock signal during a horizontal scanning period ("1H"). The carry part pulls up a carry voltage to the clock signal during the horizontal scanning period 1H. The pull-up driving part is connected to a control terminal (Q-node) common to the carry part and the pull-up part. The pull-up driving part receives a previous carry voltage from a first previous stage to turn on the pull-up part and the carry part. The ripple preventing part prevents a ripple generated at a previous Q-node of a second previous stage based on a ripple generated at the Q-node of the carry part and the pull-up part.

In an exemplary embodiment, the Q-node of the carry part and the pull-up part is an i-th Q-node disposed in an i-th stage, and the Q-node of the second previous stage is an (i−2)-th Q-node disposed in an (i−2)-th stage, where "i" is a natural number greater than or equal to 3. The i-th stage further includes a voltage input terminal to which a ground voltage is applied. The ripple preventing part electrically connects the (i−2)-th Q-node and the voltage input terminal based on a ripple generated at the i-th Q-node, and discharges a ripple generated at the (i−2)-th Q-node to the ground voltage.

The ripple preventing part includes a ripple discharge transistor including a control electrode electrically connected to the i-th Q-node, an input electrode electrically connected to the voltage input terminal and an output electrode electrically connected to the (i−2)-th Q-node.

The pull-up part includes a pull-up transistor having: a control electrode connected to the i-th Q-node; an input electrode which receives the clock signal; and an output electrode which outputs the gate voltage as an i-th gate voltage. A ratio of a channel width to a channel length of the ripple discharge transistor is less than a ratio of a channel width to a channel length of the pull-up transistor.

The carry part includes a carry transistor. The carry transistor includes: a control electrode connected to the i-th Q-node; an input electrode which receives the clock signal; and an output electrode which outputs the carry voltage; and a first capacitor connected between the control electrode and the output electrode of the carry transistor.

The pull-up driving part includes a buffer transistor having: an input electrode which receives a previous carry voltage from an (i−1)-th stage; a control electrode which receives the previous carry voltage from the (i−1)-th stage; and an output electrode connected to the i-th Q-node The pull-up driving part further includes a second capacitor connected between the control electrode and the output electrode of the pull-up transistor.

The i-th stage further includes: a holding part which holds the pull-up part and the carry part in a turn-off state; and an inverter which operates so as to perform one of turn on the holding part and turn off the holding part based on the clock signal.

The holding part includes a holding transistor having: a control electrode connected to an output terminal of the inverter; an input electrode which receives the ground voltage; and an output electrode connected to an output terminal of the pull-up driving part.

The gate driving circuit further includes a pull-down part which discharges the i-th gate voltage to the ground voltage based on an (i+1)-th gate voltage from an (i+1)-th stage.

The pull-down part includes a first pull-down transistor having: a control electrode which receives the (i+1)-th gate voltage; an input electrode connected to the voltage input terminal; and an output electrode connected to an output terminal of the pull-up part. The pull-down part further includes a second pull-down transistor having: a control electrode which receives the (i+1)-th gate voltage; an input electrode connected to the voltage input terminal; and an output electrode connected to the i-th Q-node.

A ratio of a channel width to a channel length of the second pull-down transistor is approximately equal to the ratio of the channel width to the channel length of the ripple discharge transistor.

In an alternative exemplary embodiment of the present invention, a display apparatus includes a display part which displays an image based on a gate signal and a data signal, a data driving circuit which applies the data signal to the display part, a gate driving circuit including stages to sequentially apply the gate signal to the display part, the stages being cascaded with each other and each of the stages comprising: a pull-up part which pulls up a gate voltage to a clock signal during a horizontal scanning period (1H); a carry part which pulls up a carry voltage to the clock during the horizontal scanning period (1H); a pull-up driving part connected to a control terminal (Q-node) common to the carry part and the pull-up part and which receives a previous carry voltage from a first previous stage to turn on the pull-up part and the carry part; and a ripple preventing part which prevents a ripple generated at a previous Q-node of a second previous stage based on a ripple generated at the Q-node of the carry part and the pull-up part.

The Q-node of the carry part and the pull-up part is an i-th Q-node disposed in an i-th stage, the Q-node of the second previous stage is an (i−2)-th Q-node disposed in an (i−2)-th stage, and "i" is a natural number greater than or equal 3.

The i-th stage further includes a voltage input terminal to which a ground voltage is applied, and the ripple preventing part electrically connects the (i−2)-th Q-node and the voltage input terminal based on a ripple generated at the i-th Q-node to discharge a ripple generated at the (i−2)-th Q-node to the ground voltage.

The ripple preventing part comprises a ripple discharge transistor including: a control electrode electrically connected to the i-th Q-node; an input electrode electrically connected to the voltage input terminal; and an output electrode electrically connected to the (i−2)-th Q-node.

In yet another alternative exemplary embodiment of the present invention, a method for driving a gate driving circuit having cascaded stages includes: pulling up a gate voltage to a clock signal during a horizontal scanning period (1H) using a pull-up part; pulling up a carry voltage to the clock signal during the horizontal scanning period (1H) using a carry part; receiving a previous carry voltage from a first previous stage with a pull-up driving part connected to a control terminal (Q-node) common to the carry part and the pull-up part to turn on the pull-up part and the carry part; and preventing a ripple generated at a previous Q-node of a second previous stage based on a ripple generated at the Q-node of the carry part and the pull-up part using a ripple preventing part.

The Q-node of the carry part and the pull-up part is an i-th Q-node disposed in an i-th stage, the Q-node of the second previous stage is an (i−2)-th Q-node disposed in an (i−2)-th stage, and "i" is a natural number greater than or equal 3.

Accordingly, a ripple generated at a previous Q-node disposed in a previous stage is effectively prevented using a ripple generated at a present Q-node disposed in a present stage. Therefore, a drive malfunction of the gate driving circuit is substantially reduced and/or effectively prevented, thereby improving abnormal- and/or high-temperature operational reliability of the gate driving circuit according to an exemplary embodiment of the present invention, and a display device having the same.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
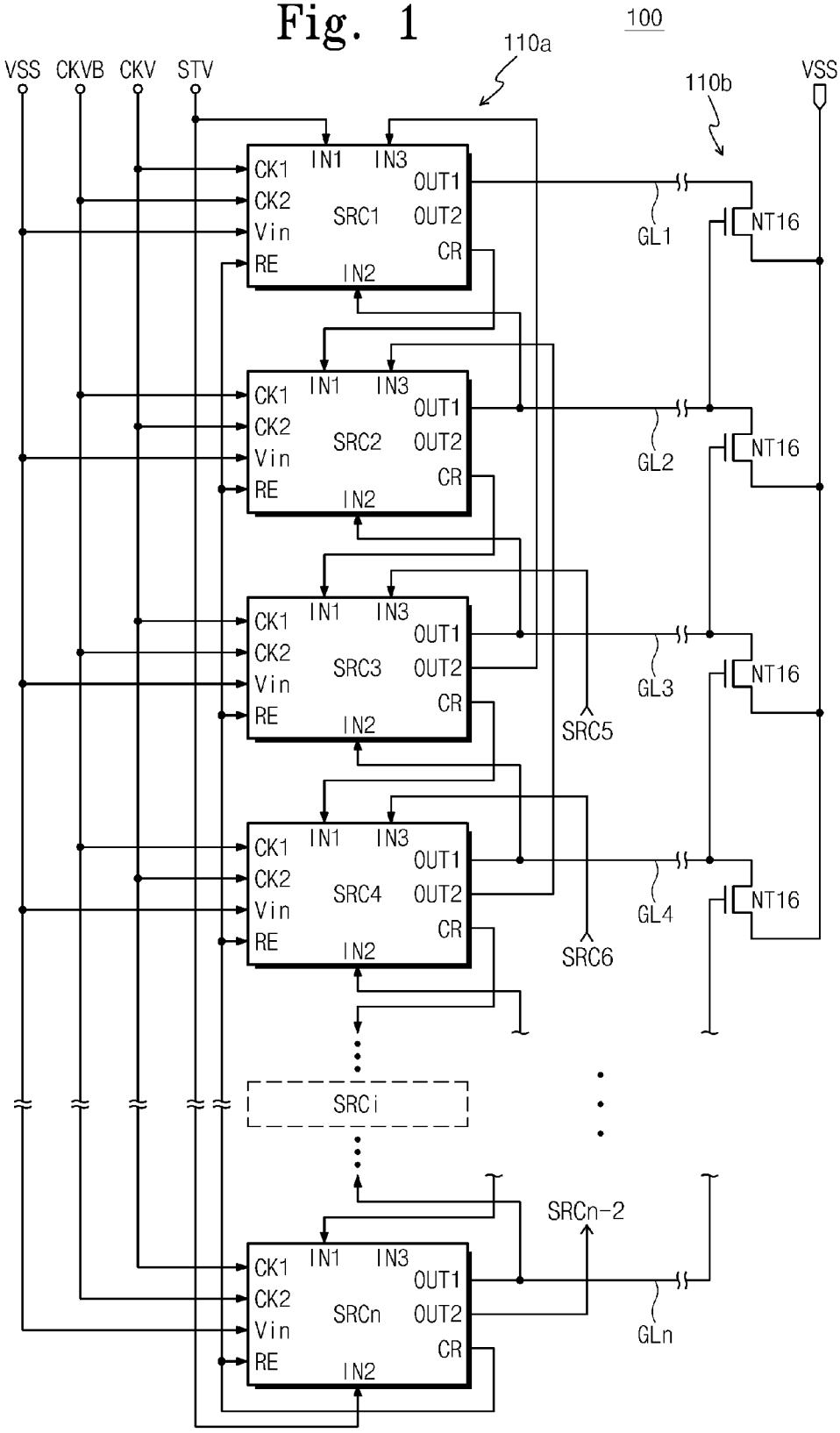
FIG. 1 is a block diagram of a gate driving circuit according to an exemplary embodiment the present invention.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Hereinafter, exemplary embodiments of the present invention will be described in further detail with reference to the accompanying drawings.

FIG. 1 is a block diagram of a gate driving circuit according to an exemplary embodiment the present invention.

Referring to FIG. 1, a gate driving circuit 100 includes a shift register 110*a* having a plurality of stages SRC1-SRCn. Adjacent individual stages, e.g., stages SRC1, SRC2, SRC3, . . . , SRCn, within the plurality of stages SRC1-SRCn are connected to one another. More specifically, individual stages of the plurality of stages are cascaded, as shown FIG. 1 and described in further detail below.

Each stage of the plurality of stages includes a first input terminal IN1, a first clock terminal CK1, a second clock terminal CK2, a second input terminal IN2, a third input terminal IN3, a voltage input terminal Vin, a reset terminal RE, a first output terminal OUT1, a second output terminal OUT2 and a carry terminal CR.

The first input terminal IN1 of a current stage is electrically connected to a carry terminal CR of an adjacent previous stage to receive a previous carry voltage. A first input terminal IN1 of a first stage SRC1 of the plurality of stages SRC1-SRCn, however, receives a start signal STV which starts a drive operation of the gate driving circuit 100.

The second input terminal IN2 of the current stage is electrically connected to a first output terminal OUT1 of an adjacent subsequent stage to receive a next stage output signal, a gate voltage, output through the first output terminal OUT1 of the adjacent subsequent stage. A second input terminal IN2 of a last stage SRCn, e.g., an n-th stage SRCn, of the plurality of stages SRC1-SRCn, however, receives the start signal STV.

Third input terminals IN3 of odd-numbered stages SRC1, SRC3, . . . , SRCn of the plurality of stages SRC1-SRCn are connected to respective second output terminals OUT2 of subsequent odd-numbered stages of the odd-numbered stages SRC1, SRC3, . . . , SRCn. For example, a third input terminal IN3 of an odd-numbered stage SRC1 is connected to a second output terminal OUT2 a next odd-numbered stage SRC3, as shown in FIG. 1. Thus, when a ripple is generated at a Q-node (described in further detail below with reference to FIG. 2) of a next odd-numbered stage, e.g., odd-numbered stage SRC3, the third input terminal IN3 of a present odd-numbered stage, e.g., odd-numbered stage SRC1, receives a ground voltage VSS through a second output terminal OUT2 of the next odd-numbered stage SRC3.

Similarly, even-numbered stages SRC2, SRC4, . . . , SRCn−1 of the plurality of stages SRC1-SRCn are connected to respective second output terminals OUT2 of subsequent even-numbered stages of the even-numbered stages SRC2, SRC4, . . . , SRCn−1. Therefore, when a ripple is generated at a Q-node of a subsequent even-numbered stage, e.g., even-numbered stage SRC4, the third input terminal IN3 of a previous even-numbered stage, e.g., even-numbered stage SRC2, receives the ground voltage VSS through the second output terminal OUT2 of the subsequent even-numbered stage, e.g., SRC4.

More generally, a second output terminal OUT2 of an i-th stage SRCi of the plurality of stages SRC1-SRCn is connected to a third input terminal IN3 of an (i−2)-th stage (not shown), and a third input terminal IN3 of the i-th stage SRCi is electrically connected to a second output terminal OUT2 of an (i+2)-th stage (not shown). Specifically, as shown in FIG. 1, a second output terminal OUT2 of a fourth stage SRC4 is connected to a third input terminal IN3 of a second stage SRC2, and a third input terminal IN3 of the fourth stage SRC4 is connected to a second output terminal OUT2 of a sixth stage SRC6 (not shown). However, a second output terminal OUT2 of the first stage SRC1 and a second output terminal OUT2 of the second stage SRC2 are not connected to other stages. Likewise, a third input terminal IN3 of the last stage SRCn and a third input terminal IN3 of a next-to-last stage SRCn−1 (not shown) immediately adjacent to and previous to the last stage SRCn are not connected to other stages. It will be noted that for purposes of simplified illustration, the fifth stage SRC5, the next-to-last-stage SRCn−1, and all stages therebetween, e.g., stages SRC6 through SRCn−2, are not illustrated in FIG. 1, but are instead illustrated by ellipses.

First clock terminals CK1 of the odd-numbered stages SRC1, SRC3, . . . , SRCn of the plurality of stages SRC1-SRCn receive a first clock CKV having a high level and a low level, and second clock terminals CK2 of the odd-numbered stages SRC1, SRC3, . . . , SRCn the plurality of stages SRC1-SRCn receive a second clock CKVB having the high level and the low level, and an opposite phase to a phase of the first clock CKV. On the other hand, first clock terminals CK1 of the even-numbered stages SRC2, SRC4, . . . , SRCn−1 of the plurality of stages SRC1-SRCn receive the second clock CKVB, and second clock terminals CK2 of the even-numbered stages SRC2, SRC4, . . . , SRCn−1 of the plurality of stages SRC1-SRCn receive the first clock CKV.

Voltage input terminals Vin of the stages SRC1-SRCn each receive the ground voltage VSS. A carry terminal CR of the last stage SRCn is commonly connected to reset terminals RE of each of the stages SRC1-SRCn, as shown in FIG. 1.

First output terminals OUT1 of the stages SRC1-SRCn are electrically connected to a plurality of gate lines GL1-GLn, respectively. Thus, the stages SRC1-SRCn sequentially output the gate voltage through the first output terminals OUT1 and sequentially apply the gate voltage to gate lines GL1, GL2, . . . , GLn of the plurality of gate lines GL1-GLn, as will be described in further detail below with reference to FIG. 5.

As shown in FIG. 1, the shift register 110*a* is disposed adjacent to first ends of the gate lines GL1, GL2, . . . , GLn. In an exemplary embodiment, the gate driving circuit 100 further includes a discharge circuit 110*b* disposed adjacent to second ends, opposite the first ends, of the gate lines GL1, GL2, . . . , GLn and discharges a present gate line, e.g., gate line GL1, to the ground voltage VSS in response to a next gate voltage output from a subsequent stage, e.g., stage SRC2.

In an exemplary embodiment of the present invention, the discharge circuit 110*b* includes an equal number of discharge transistors NT16 as a number of the gate lines GL1, GL2, . . . , GLn, and each of the discharge transistors NT16 includes a control electrode connected to a subsequent gate line, e.g., the gate line GL2 an input electrode receiving the ground voltage VSS as an off voltage, and an output electrode connected to the present gate line, e.g., the gate line GL1.

Figure 2:
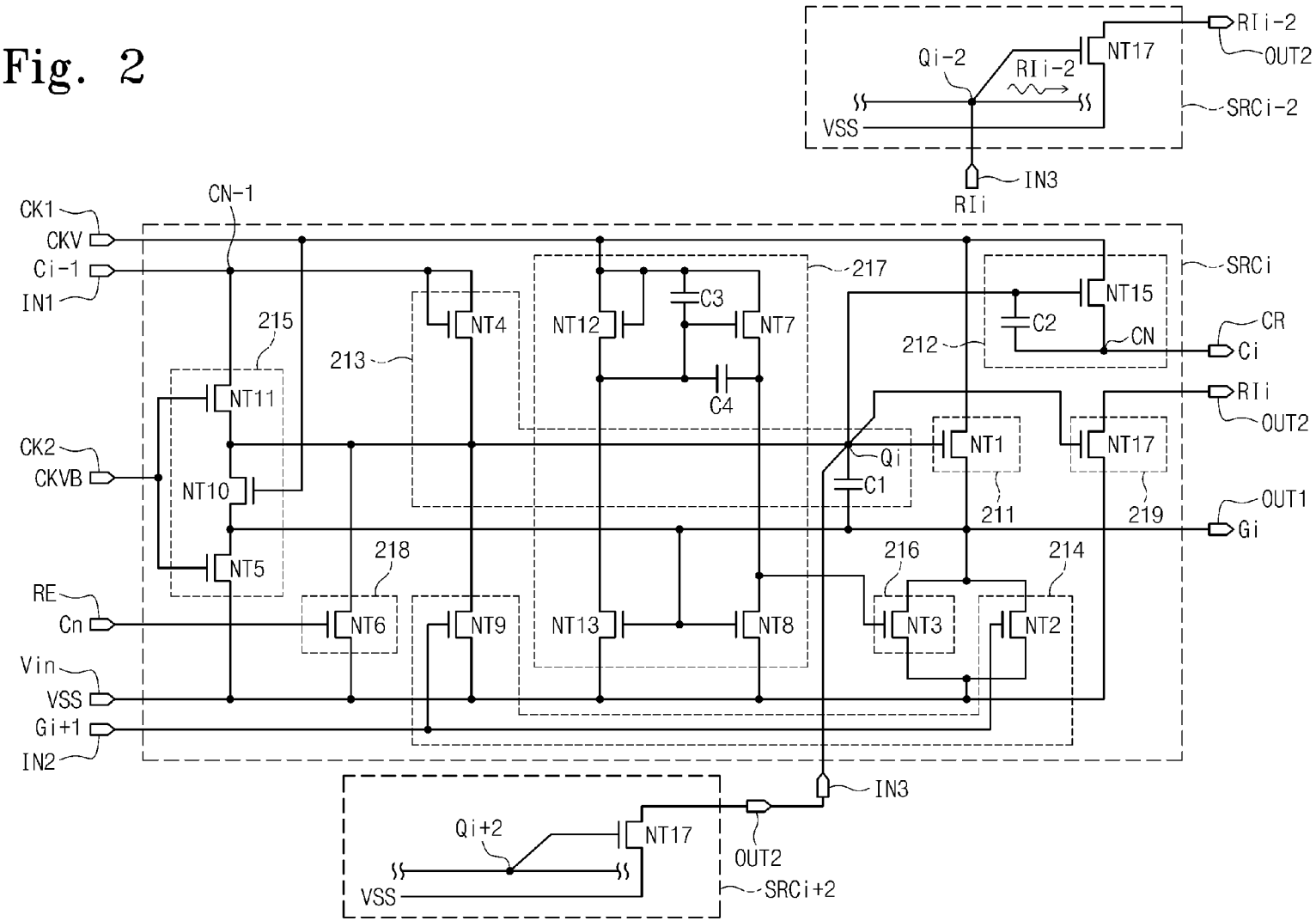
FIG. 2 is a schematic circuit diagram of an i-th stage of the gate driving circuit according to the exemplary embodiment of the present invention shown in FIG. 1.

FIG. 2 is a schematic circuit diagram of an i-th stage of the gate driving circuit according to the exemplary embodiment of the present invention shown in FIG. 1. In FIG. 2, an inner circuit schematic configuration of an odd-numbered i-th stage SRCi is illustrated as representative of each of the stages SRC1-SRCn, since each of the stages SRC1-SRCn of the gate driving circuit 100 according to an exemplary embodiment have substantially the same inner circuit configurations and/or functions. In an exemplary embodiment, a number represented by "i" is a natural number greater than 1, and a number represented by "n" is a natural number greater than "i".

Referring to FIG. 2, the i-th stage SRCi includes a pull-up part 211, a carry part 212, a pull-up driving part 213, a pull-down part 214, a ripple controller 215, a holding part 216, an inverter 217, a reset part 218 and a ripple preventing part 219.

The pull-up part 211 includes a pull-up transistor NT1 including a control electrode connected to an output terminal (hereinafter, generally referred to as a "Q-node", and, more particularly when referring to the i-th stage SRCi, an "i-th Q-node") Qi of the pull-up driving part 213, an input electrode connected to the first clock terminal CK1 and an output electrode connected to the first output terminal OUT1. In operation, the pull-up transistor NT1 pulls up an i-th gate voltage Gi input to the first output terminal OUT1 to the high level of first clock CKV applied through the first clock terminal CK1 in response to a control voltage output from the pull-up driving part 213. More specifically, the pull-up transistor NT1 is turned on during one horizontal scanning period ("1H") corresponding to a high period of the first clock CKV, e.g., a period during which the first clock CKV is at the high level, in one frame and maintains the i-th gate voltage Gi in a high state during the 1H period in the one frame.

The carry part 212 includes a carry transistor NT15 and a second capacitor C2. The carry transistor NT15 includes a control electrode connected to the i-th Q-node Qi, an input electrode connected to the first clock terminal CK1 and an output electrode connected to the carry terminal CR. The second capacitor C2 is connected between the control electrode of the carry transistor NT15 and the carry terminal CR. Thus, the carry transistor NT15 pulls up an i-th carry voltage Ci, which is input to the carry terminal CR to the high level of the first clock CKV in response to the control voltage output from the pull-up driving part 213. In addition, the carry transistor NT15 is turned on during the 1H period in the one frame and maintains the i-th carry voltage Ci in a high state during the 1H period in the one frame.

Consequently, the i-th gate voltage Gi, output from the pull-up part 211, and the i-th carry voltage Ci, output from the carry part 212, are substantially the same signals which are generated during the same time period (e.g., during the 1H period of the one frame). Thus, when the carry part 212 is included in the gate driving circuit 100 according to an exemplary embodiment of the present invention, a shading effect is substantially reduced and/or effectively minimized, since a load on the pull-up part 211 substantially decreases. In an exemplary embodiment, a node to which the carry terminal CR and the output electrode of the carry transistor NT15 are connected to is referred to as an i-th carry node CN, as shown in FIG. 2.

The pull-up driving part 213 includes the i-th Q-node Qi, a buffer transistor NT4 and a first capacitor C1. The i-th Q-node Qi is connected to the third input terminal IN3, and the third input terminal IN3 is connected to the second output terminal OUT2 of the (i+2)-th stage SRCi+2. The buffer transistor NT4 includes an input electrode and a control electrode commonly connected to the first input terminal IN1, and an output electrode connected to the i-th Q-node Qi. The first capacitor C1 is connected between the i-th Q-node Qi and the first output terminal OUT1.

When the buffer transistor NT4 is turned on in response to an (i−1)-th carry voltage Ci−1, an electric potential of the i-th Q-node Qi increases to the (i−1)-th carry voltage Ci−1. More specifically, the electric potential of the i-th Q-node Qi is precharged to the (i−1)-th carry voltage Ci−1 when the buffer transistor is turned on. Therefore, an electric potential at the i-th Q-node is precharged to the (i−1)-th carry voltage Ci−1 and is boosted up by the first capacitor C1 during a high period of the first clock CKV lasting 1H. As a result, the electric potential of the i-th Q-node Qi increases such that the electric potential of the i-th Q-node Qi is greater than a threshold voltage of the pull-up transistor NT1, thereby turning on the pull-up transistor NT1. Accordingly, the first clock CKV is input to the first output terminal OUT1 and the carry terminal CR, and the i-th gate voltage Gi and the i-th carry voltage Ci are changed to a high state. Further, the i-th gate voltage Gi and the i-th carry voltage Ci are maintained at the high state during the high period of the first clock CKV for 1H.

Still referring to FIG. 2, the pull-down part 214 includes a first pull-down transistor NT2 and a second pull-down transistor NT9. The first pull-down transistor NT2 includes a control electrode connected to the second input terminal IN2, an input electrode connected to the voltage input terminal Vin and an output electrode connected to the first output terminal OUT1. The second pull-down transistor NT9 includes a control electrode connected to the second input terminal IN2, an input electrode connected to the voltage input terminal Vin and an output electrode connected to the i-th Q-node Qi. In operation, the first pull-down transistor NT2 pulls down the i-th gate voltage Gi pulled up by the first clock CKV to the ground voltage VSS applied through the voltage input terminal Vin in response to the (i+1)-th gate voltage Gi+1. Specifically, the i-th gate voltage Gi is decreased to a low state, e.g., to the low level of the first clock CKV, after the 1H period. In addition, the second pull-down transistor NT9 discharges the first capacitor C1 to the ground voltage VSS in response to the (i+1)-th gate voltage Gi+1. Thus, the electric potential of the i-th Q-node Qi is pulled down to the ground voltage VSS by the (i+1)-th gate voltage Gi+1. As a result, the pull-up transistor NT1 and the carry transistor NT15 are turned off. In other words, the second pull-down transistor NT9 is turned on after the 1H period to turn off the pull-up transistor NT1 and the carry transistor NT15, and thereby prevents an output of the present gate voltage Gi in a high state and an output of the present carry voltage Ci in the high state to the first output terminal OUT1 and the carry terminal CR, respectively, during the low period of the first clock CKV for a subsequent 1H.

The ripple controller 215 includes a first ripple control transistor NT5, a second ripple control transistor NT10 and a third ripple control transistor NT11.

The first ripple control transistor NT5 includes an input electrode connected to the first output terminal OUT1, a control electrode connected to the second clock terminal CK2 and an output electrode connected to the voltage input terminal Vin.

The second ripple control transistor NT10 includes a control electrode connected to the first clock terminal CK1, an input electrode connected to the i-th Q-node Qi and an output electrode connected to the first output terminal OUT1.

The third ripple control transistor NT11 includes a control electrode connected to the second clock terminal CK2, an input electrode connected to the first input terminal IN1 and an output electrode connected to the i-th Q-node Qi.

The first ripple control transistor NT5 electrically connects the first output terminal OUT1 and the voltage input terminal Vin in response to the second clock CKVB applied to the second clock terminal CK2. Thus, the i-th gate voltage Gi of the first output terminal OUT1 is discharged to the ground voltage VSS through the first ripple control transistor NT5.

The second ripple control transistor NT10 electrically connects the first output terminal OUT1 and the i-th Q-node Qi in response to the first clock CKV. Therefore, the electric potential of the i-th Q-node Qi is lowered to the i-th gate voltage Gi at the ground voltage VSS. Accordingly, the electric potential of the Q-node QN is held at the ground voltage VSS in the high period of the first clock CKV during a adjacent previous horizontal period (n−1)H. Specifically, the second ripple control transistor NT10 prevents the pull-up transistor NT1 and the carry transistor NT15 from being turned on in the high period of the first clock CKV during the (n−1)H period.

The third ripple control transistor NT11 is turned on in response to the second clock CKVB applied through the second clock terminal CK2 to electrically connect a node CN-1 to the i-th Q-node Qi. Therefore, the third ripple control transistor NT11 discharges an electric potential of the node CN-1 to the ground voltage VSS by the electric potential of the i-th Q-node Qi held at the ground voltage VSS. As a result, the third ripple control transistor NT11 prevent a ripple at the node CN-1.

The holding part 216 includes a holding transistor NT3 including a control electrode connected to an output terminal of the inverter 217, an input electrode connected to the voltage input terminal Vin and an output electrode connected to the first output terminal OUT1.

The inverter 217 includes a first inverter transistor NT12, a second inverter transistor NT7, a third inverter transistor NT13, a fourth inverter transistor NT8, a third capacitor C3 and a fourth capacitor C4. In operation, the inverter 217 turns on or turns off the holding transistor NT3.

The first inverter transistor NT12 includes an input electrode and a control electrode commonly connected to the first clock terminal CK1 and an output electrode connected to an output electrode of the second inverter transistor NT7 through the fourth capacitor C4. The second inverter transistor NT7 includes an input electrode connected to the first clock terminal CK1, a control electrode connected to the input electrode thereof through the third capacitor C3, and an output electrode connected to the control electrode of the holding transistor NT3. The third inverter transistor NT13 includes an input electrode connected to the output electrode of the first inverter transistor NT12, a control electrode connected to the first output terminal OUT1 and an output electrode connected to the voltage input terminal Vin. The fourth inverter transistor NT8 includes an input electrode connected to the control electrode of the holding transistor NT3, a control electrode connected to the first output terminal OUT1 and an output electrode connected to the voltage input terminal Vin.

The third inverter transistor NT13 and the fourth inverter transistor NT8 are turned on in response to the i-th gate voltage Gi at the high state output through the first output terminal OUT1, and the first clock CKV output from the first inverter transistor NT12 and the second inverter transistor NT7 are thereby discharged to the ground voltage VSS. Thus, the holding transistor NT3 is maintained in a turn-off state during the 1H period during which the i-th gate voltage Gi is maintained in the high state.

Then, when the i-th gate voltage Gi transitions to a low state, the third inverter transistor NT13 and the fourth inverter transistor NT8 are turned off. Thus, the holding transistor NT3 is turned on in response to the first clock CKV output from the first inverter transistor NT12 and the second inverter transistor NT7. As a result, the i-th gate voltage Gi is held at the ground voltage VSS by the holding transistor NT3 during the high period 1H of the first clock CKV during the (n−1)H period.

Referring still to FIG. 2, the reset part 218 includes a reset transistor NT6 including a control electrode connected to the reset terminal RE, an input electrode connected to the control electrode of the pull-up transistor NT1 and an output electrode connected to the voltage input terminal Vin. The reset transistor NT6 discharges noise, input through the first input terminal IN1, to the ground voltage VSS in response to a last carry voltage Cn input through the reset terminal RE of each of the stages SRC1-SRCn and output from the last stage SRCn. Accordingly, the pull-up transistor NT1 and the carry transistor NT15 are turned off in response to the last carry voltage Cn of the last stage SRCn. Consequently, the last carry voltage Cn is provided to reset terminals RE of n previous stages to turn off the pull-up transistors NT1 and the carry transistors NT15 arranged in the n previous stages SRC1-SRCn and resets the n previous stages SRC1-SRCn.

The ripple preventing part 219 includes a ripple discharge transistor NT17 including a control electrode connected to the i-th Q-node Qi, an input electrode connected to the voltage input terminal Vin and an output electrode connected to the second output terminal OUT2. The second output terminal OUT2 is connected to the third input terminal IN3 of the (i−2)-th stage SRCi−2 (partially shown in FIG. 2). Thus, the output electrode of the ripple discharge transistor NT17 in the i-th stage SRCi is connected to an (i−2)-th Q-node Qi−2 in the (i−2)-th stage SRCi−2. In an exemplary embodiment of the present invention, a size of the ripple discharge transistor NT17 is less than a size of the pull-up transistor NT1. Therefore, the pull-up transistor NT1 is not turned on before the ripple discharge transistor NT17 is turned on, even when a ripple generated at the i-th Q-node Qi changes.

The ripple discharge transistor NT17 prevents an (i−2)-th ripple RIi−2 from being generated at the (i−2)-th Q-node Qi−2 in response to an i-th ripple RIi generated at the i-th Q-node Qi. Specifically, when the i-th ripple RIi is generated at the i-th Q-node Qi by one of the first clock CKV and the second clock CKVB, the i-th ripple RIi is boosted up by the first capacitor C1 connected to the i-th Q-node Qi. Further, the pull-up driving part 213 boosts up not only the carry voltage Ci−1 precharged during the high period 1H of the first clock CKV but also the i-th ripple RIi generated at the i-th Q-node Qi during the period (n−1)H except the high period 1H of the first clock CKV. More specifically, when a voltage of the boosted-up i-th ripple RIi increases above a threshold voltage of the ripple discharge transistor NT17, the ripple discharge transistor NT17 is turned on. Therefore, a voltage level of the (i−2)-th ripple RIi−2 generated at the (i−2)-th Q-node Qi−2 is discharged to the ground voltage VSS through the ripple discharge transistor NT17 of the i-th stage SRCi. As a result, the ripple RIi−2 generated at the (i−2)-th Q-node Qi−2 is removed, e.g., is effectively prevented, by the ripple discharge transistor NT17 disposed in the i-th stage SRCi according to an exemplary embodiment of the present invention.

A drive malfunction may occur at the (i−2)-th stage SRCi−2 under a high temperature, e.g., at an elevated (non-normal) operating temperature, and causes a drive malfunction of a subsequent stage SRCi−1 (not shown). Specifically, the ripple generated at the (i−2)-th Q-node Qi−2 in the (i−2)-th stage SRCi−2 is included in a voltage level of the control voltage (e.g., a carry voltage Ci−1) which controls the subsequent stage SRCi−1, relative to the (i−2)-th stage SRCi−2, to thereby cause the drive malfunction of the next stage SRCi−1. Likewise, a drive malfunction of the next stage SRCi−1 may cause a drive malfunction of the i-th stage SRCi, as well. As a result, the drive malfunction occurs in the (i−2)-th stage SRCi−2 causes drive malfunctions in not only the (i−2)-th stage SRCi−2 and the next stage SRCi−1, but also in other cascaded stages SRCi−1, SRCi, . . . , SRCn, due to a cascade effect.

However, since each stage of the shift register 110*a* according to an exemplary embodiment of the present invention includes the ripple preventing part 219, the above-described drive malfunction substantially reduced and/or is effectively prevented. Specifically, when the ripple RIi−2 is generated at the (i−2)-th Q-node Qi−2 in the (i−2)-th stage SRCi−2 of the plurality of stages SRC1-SRCn, the ripple preventing part 219 disposed in the i-th stage SRCi discharges the ripple generated at the (i−2)-th Q-node Qi−2 to the ground voltage VSS, as described above in greater detail with reference to FIG. 2. Thus, drive malfunctions sequentially caused in cascaded stages are thereby effectively prevented in the shift register 110*a* according to an exemplary embodiment.

Figure 3:
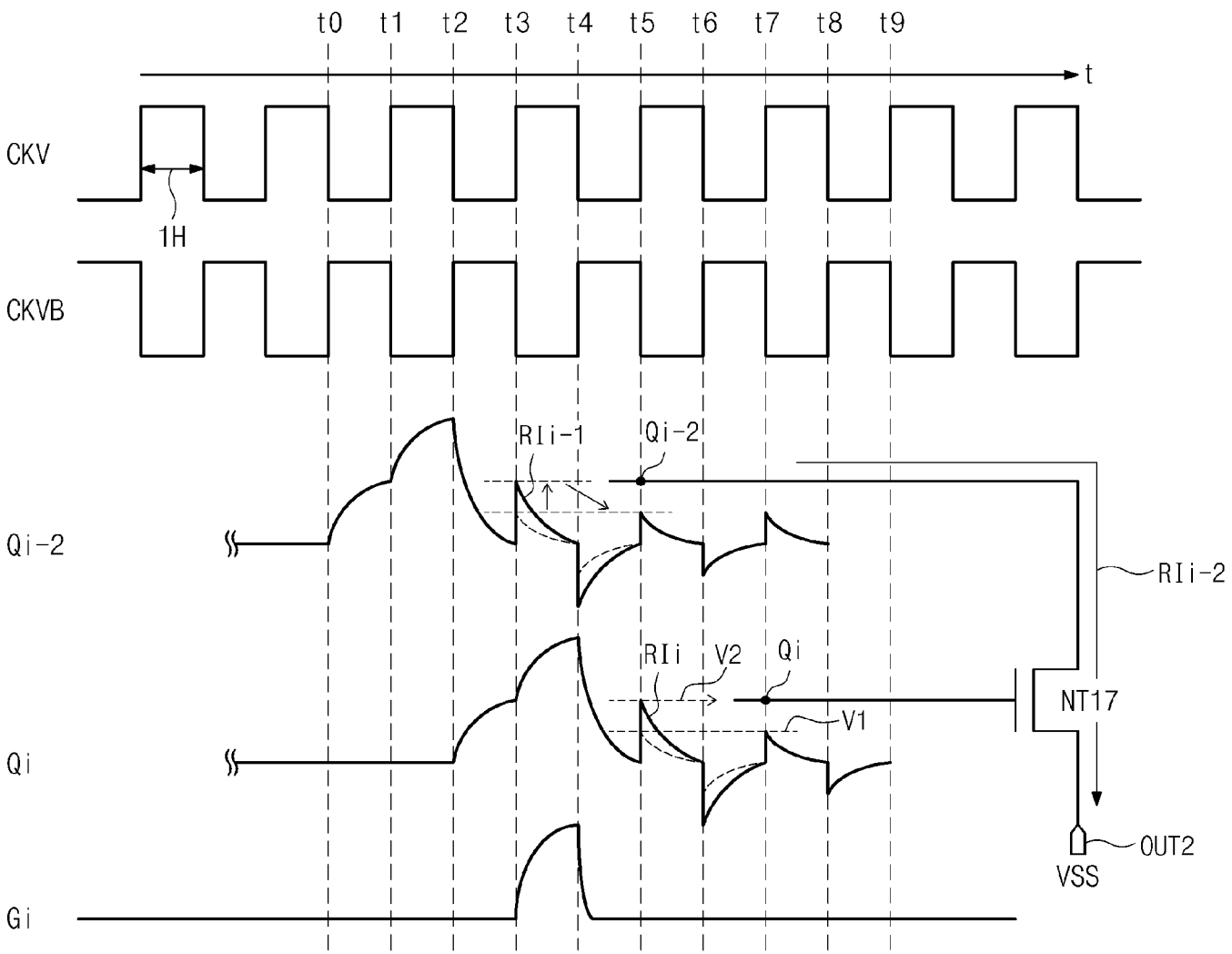
FIG. 3 is a signal timing diagram illustrating an operation of the i-th stage of the gate driving circuit according to the exemplary embodiment of the present invention shown in FIG. 2.

FIG. 3 is a signal timing diagram illustrating an operation of the i-th stage of the gate driving circuit according to the exemplary embodiment of the present invention shown in FIG. 2. In FIG. 3, an operational process will be described in further detail based on an assumption that the ripple RIi−2 first reaches a noise level (e.g., a higher voltage level than a threshold voltage of the ripple discharge transistor NT17) and is generated at the (i−2)-th Q-node Qi in the (i−2)-th stage SRCi−2.

Referring to FIG. 3, the first clock CKV and the second clock CKVB have phase which are from each other. Specifically, the first clock CKV is maintained at the high level during a time period t1-t2, a time period of t3-t4 and a time period of t5-t6, while the second clock CKVB is maintained at the high level during a time period of t0-t1, a time period of t2-t3 and a time period of t4-t5. In an exemplary embodiment, the low level of the first clock CKV and the second clock CKVB is equal to approximately −12V and, the high level of the first clock CKV and the second clock CKVB is equal to approximately 20V, but alternative exemplary embodiments are not limited thereto.

Although not shown in FIG. 3, in the time period of t2-t3 during which the second clock CKVB is maintained in the high level, the (i−1)-th carry voltage Ci−1 (shown in FIG. 2) is input to the buffer transistor NT4 of the i-th stage SRCi. Thus, during the time period of t2-t3, the i-th Q-node Qi of the i-th stage SRCi is precharged to the (i−1)-th carry voltage Ci−1, and the precharged (i−1)-th carry voltage Ci−1 is pulled up to the first clock CKV during the time period of t3-t4. Specifically, the precharged (i−1)-th carry voltage Ci−1 is boosted up. Then, during the time period of t4-t5, the electric potential of the i-th Q-node Qi pulled up to the first clock CKV is pulled down to the ground voltage VSS by the pull-down part 214.

After the time point of t5, if a voltage level V1 of the ripple RIi generated at the i-th Q-node Qi is lower than the threshold voltage of the ripple discharge transistor NT17, e.g., as shown at the time point of t7, the ripple discharge transistor NT17 is maintained in a turned-off state. In contrast, if after the time point of t5, a voltage level V2 of the ripple RIi generated at the i-th Q-node Qi is higher than the threshold voltage of the ripple discharge transistor 17, e.g., as shown at the time point of t5, the ripple discharge transistor NT17 is turned on, and the ground voltage VSS is applied to the (i−2)-th Q-node Qi−2 in the (i−2)-th stage SRCi−2. Accordingly, the (i−2)-th ripple RIi−2 which reaches a noise level greater than the threshold voltage of the ripple discharge transistor NT17 of the i-th stage SRCi is discharged to the ground voltage VSS, thereby preventing drive malfunction of the (i−2)-th stage SRCi−2. Further, when the (i−2)-th ripple RIi−2 is generated at the (i−2)-th stage SRCi−2 reaches the noise level greater than the threshold voltage of the ripple discharge transistor NT17, the i-th ripple RIi which reaches the noise level and is output from the i-th stage SRCi is also effectively prevented in the shift register 110*a* according to an exemplary embodiment of the present invention.

As a result, since a ripple generated at given stage is prevented from reaching the noise level greater than the threshold voltage of the ripple discharge transistor NT17, a ripple which reaches the noise level in an adjacent subsequent stages (or stages) is effectively be prevented, even though the stages are cascaded.

In addition, since in the gate driving circuit 100 according to an exemplary embodiment of the present invention includes the ripple discharge transistor NT17 in each stage of th plurality of stages SRC1-SRCn, a circuit design of each stage is substantially simplified.

Particularly, as shown in FIG. 3, when the electric potential at the (i−2)-th Q-node Qi−2 is boosted up, as described in greater detail above, the electric potential of the i-th Q-node Qi is precharged by the (i−1)-th carry voltage Ci−1 in the time period of t2-t3 (FIG. 3) during which the boosted-up electric potential of the (i−2)-th Q-node Qi is pulled down. Thus, by designing the ripple discharge transistor NT17 to have a lower threshold voltage than that of the (i−1)-th carry voltage Ci−1, the ripple discharge transistor NT17 is turned on during the time period of t2-t3 in response to the electric potential of the i-th Q-node Qi which is precharged to the (i−1)-th carry voltage Ci−1. Thus, the (i−2)-th Q-node Qi−2 is pulled down to the ground voltage VSS during the time period of t2-t3.

As a result, the ripple discharge transistor NT17 performs substantially the same function as the second pull-down transistor NT9 disposed in each stage to lower the electric potential of the Q-node Qi to the ground voltage VSS in response to a subsequent gate voltage. Therefore, since each stage SRC1-SRCn of the gate driving circuit 100 according to an exemplary embodiment of the present invention includes the ripple discharge transistor NT17, the second pull-down transistor NT9 is not required in each stage SRC1-SRCn, and the first pull-down transistor NT2 and the second pull-down transistor NT9 may be omitted from the gate driving circuit 100. Consequently, since the ripple preventing part 219 is disposed in each stage, the pull-down driving part 214 may be removed from the gate driving circuit 100, e.g., need not be fabricated during a manufacturing process thereof, thereby substantially improving a production yield and/or production efficiency of the manufacturing process of the gate driving circuit according to an exemplary embodiment of the present invention.

Figure 4:
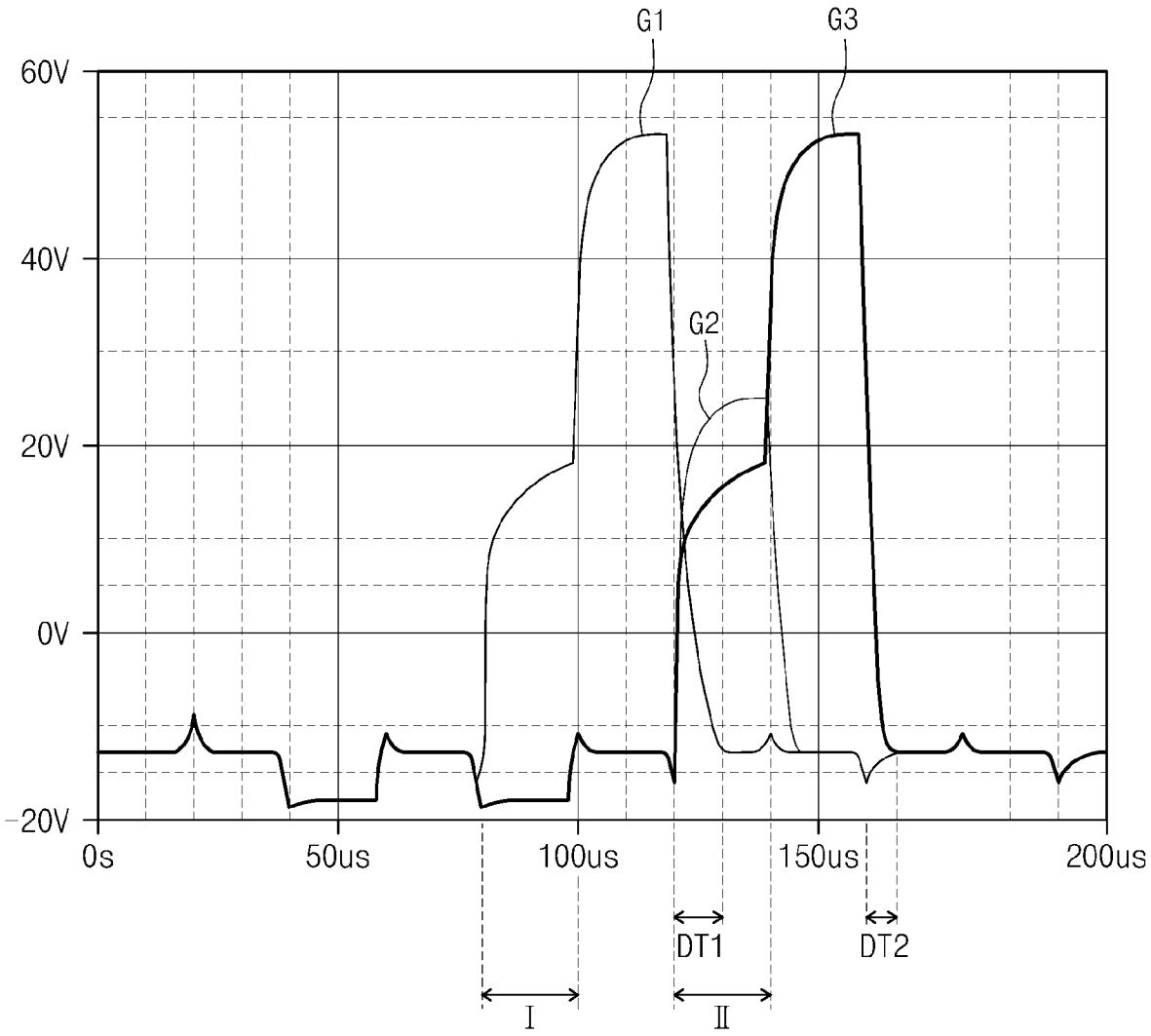
FIG. 4 is a graph of voltage versus time showing electric potentials of an i-th Q-node of a gate driving circuit having a ripple discharge transistor, an (i+1)-th gate voltage and an electric potential of an i-th Q-node of a gate driving circuit not having a ripple discharge transistor according to exemplary embodiments of the present invention.

FIG. 4 is a graph of voltage versus time showing electric potentials of the i-th Q-node of the gate driving circuit 100 having the ripple discharge transistor NT17, the (i+1)-th gate voltage, and the electric potential of the i-th Q-node of the gate driving circuit 100 not having the ripple discharge transistor NT17, according to alternative exemplary embodiments of the present invention.

In FIG. 4, an x-axis presents a time (μs), and a y-axis presents voltage (V). Further, first graph G1 is a waveform diagram of an electric potential at the i-th Q-node Qi in the gate driving circuit 100 including the ripple discharge transistor NT17 and without the second pull-down transistor NT9, second graph G2 is a waveform diagram of (i+1)-th gate voltage Gi+1, and third graph G3 is a waveform diagram of an electric potential of the i-th Q-node Qi of a gate driving circuit 100 which includes the second pull-down transistor NT9 but without the ripple discharge transistor NT17.

Referring to FIG. 4, a precharged voltage level of the i-th Q-node Qi (precharged by the (i−1)-th carry voltage Ci−1), shown in a period I of the first graph G1, is lower than a voltage level of the (i+1)-th gate voltage Gi+1, as shown in the second graph G2. Further, in a period II, during which the electric potential at the i-th Q-node Qi is discharged, a discharge time DT1 of the i-th Q-node Qi by the ripple discharge transistor NT17 is longer than a discharge time DT2 of the i-th Q-node Qi by the second pull-down transistor NT9.

In an exemplary embodiment, the second pull-down transistor NT9 (third graph G3) and the ripple discharge transistor NT17 (first graph G1) have an approximately equal size (e.g., ratios of a channel width to a channel length thereof are approximately equal).

Accordingly, as shown during the period I, the ripple discharge transistor NT17 applies the ground voltage VSS to the first output terminal OUT1 during the discharge time DT1 of the i-th Q-node Qi, and as a result, the first and second pull-down transistors NT1 and NT2 may be removed from the gate driving circuit. In an alternative exemplary embodiment of the present invention, a size of the first pull-down transistor NT2 and the second pull-down transistor NT9 may be reduced.

Consequently, since the ripple discharge transistor NT17 disposed in each stage performs substantially the same function as the pull-down driving part 214 shown in FIG. 2, the pull-down diving part 214 may be removed from each stage of an shift register 110*a* of a gate driving circuit 100 according to an exemplary embodiment of the present invention. Therefore, a circuit configuration of each stage thereof is substantially simplified, thereby reducing a manufacturing cost of the gate driving circuit 100 according to an exemplary embodiment.

Figure 5:
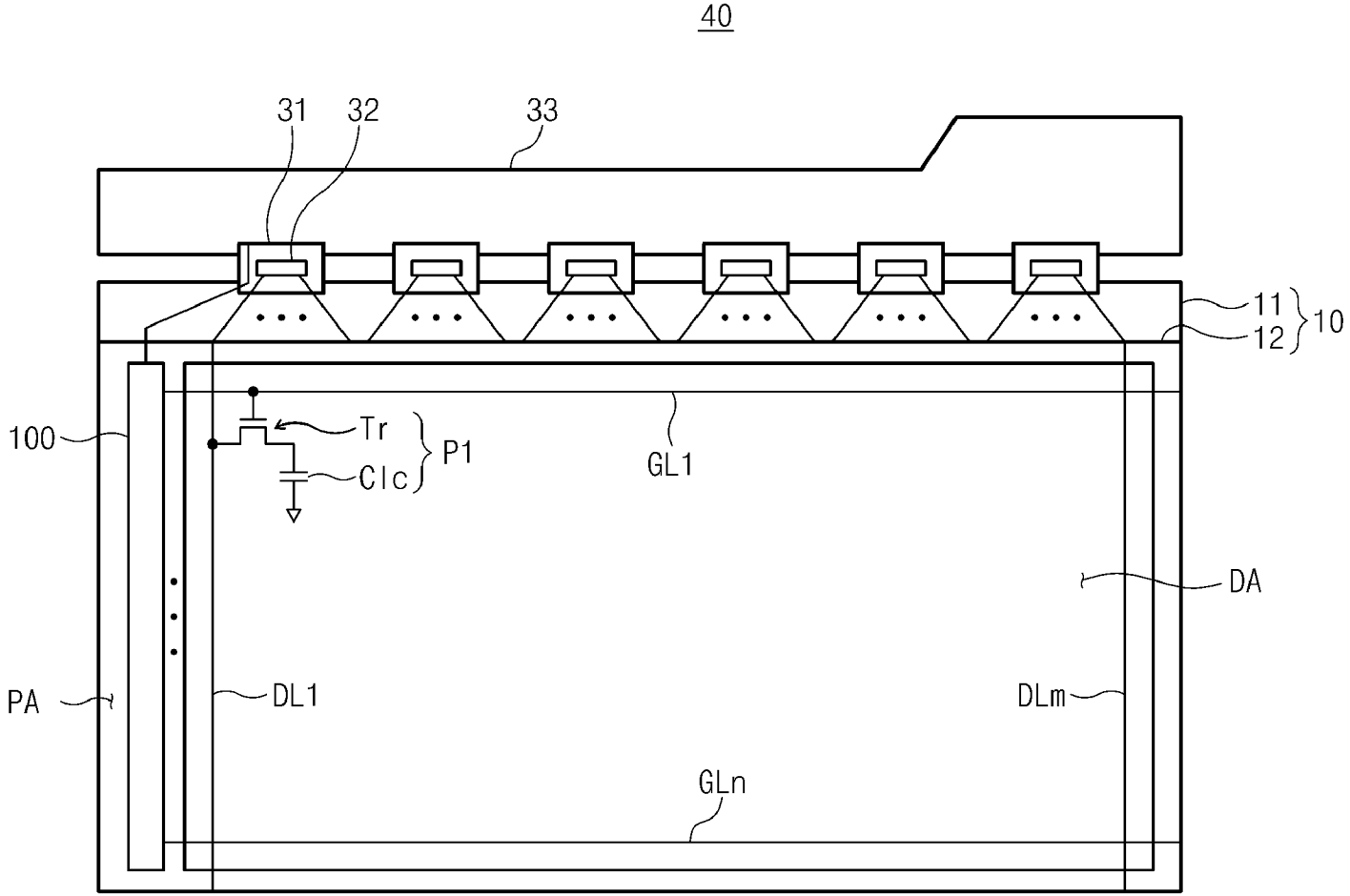
FIG. 5 is a plan view of a liquid crystal display according to an exemplary embodiment of the present invention including the gate driving circuit according to the exemplary embodiment of the present invention shown in FIG. 1.

FIG. 5 is a plan view of a liquid crystal display according to an exemplary embodiment of the present invention including the gate driving circuit 100 according to the exemplary embodiment of the present invention shown in FIG. 1.

Referring to FIG. 5, a liquid crystal display 40 includes a liquid crystal display panel 10 which displays a desired image, a plurality of data driving chips 32 which apply a data voltage to the liquid crystal display panel 10 and a gate driving circuit 100 which applies a gate voltage to the liquid crystal display panel 10.

The liquid crystal display panel 10 includes a lower substrate 11, an upper substrate 12 facing the lower substrate 11 and a liquid crystal layer (not shown) interposed between the lower substrate 11 and the upper substrate 12. The liquid crystal display panel 10 includes a display area DA in which the image is displayed, and a peripheral area PA adjacent to a peripheral area of the display area DA.

The display area DA includes a plurality of gate lines GL1-GLn and a plurality of data lines DL1-DLm. Individual data lines DL1-DLm of the plurality of data lines DL1-DLm intersect and are electrically insulated from gate lines GL1-GLn of the plurality of gate lines GL1-GLn. The display area further includes a plurality of pixel areas. In an exemplary embodiment, pixel areas of the plurality of pixel areas may be defined by the gate lines GL1-GLn and the data lines DL1-DLm. Further each pixel area includes a pixel P1 including a thin film transistor Tr and a liquid crystal capacitor Clc. In an exemplary embodiment and as shown in FIG. 5, a first thin film transistor Tr includes a gate electrode electrically connected to a first gate line GL1, a source electrode electrically connected to a first data line DL1 and a drain electrode electrically connected to a pixel electrode (not shown) which serves as a first electrode the liquid crystal capacitor Clc.

The gate driving circuit 100 is disposed adjacent to first ends of the gate lines GL1-GLn in the peripheral area PA. The gate driving circuit 100 is electrically connected to the first ends of the gate lines GL1-GLn to sequentially apply the gate voltage to the gate lines GL1-GLn. The gate driving circuit 100 was described in greater detail above with reference to FIGS. 1 to 4, and any repetitive detailed description of the gate driving circuit 100 has therefore been omitted herein.

A plurality of tape carrier packages ("TCPs") 31 is attached to the peripheral area PA adjacent to first ends of the data lines DL1-DLm. Data driving chips 32 of the plurality of data driving chips 32 are mounted on respective associated TCPs 31. The data driving chips 32 are electrically connected to the first ends of the data lines DL1-DLm to apply the data voltage to the data lines DL1-DLm.

The LCD 40 further includes a printed circuit board 33 to control a drive operation of the gate driving circuit 100 and the data driving chips 32. Specifically, the printed circuit board 33 outputs a data control signal which controls a drive operation of the data driving chips 32, image data, and a gate control signal which controls the drive operation of the gate driving circuit 100. The data control signal and the image data are provided to the data driving chips 32 through the TCPs 31. The gate control signal is provided to the gate driving circuit 100 through an adjacent TCP 31 to the gate driving circuit 100.

According to the exemplary embodiments of the present invention as described herein, a ripple generated at a previous Q-node included in a previous stage is prevented using a ripple generated at a present Q-node arranged in a present stage. Therefore, a drive malfunction of a gate driving circuit according to an exemplary embodiment of the present invention is effectively prevented, thereby substantially improving high-temperature reliability of the gate driving circuit and an LCD including the same.

The present invention should not be construed as being limited to the exemplary embodiments set forth herein. Rather, these exemplary embodiments are provided so that this disclosure will be thorough and complete and will fully convey the concept of the present invention to those skilled in the art.

Although the present invention has been particularly shown and described with reference to exemplary embodiments thereof, it will be understood by those of ordinary skill in the art that various changes in form and details may be made therein without departing from the spirit or scope of the present invention as defined by the following claims.

What is claimed is:

1. A gate driving circuit comprising stages, the stages being cascaded with each other and each comprising:

a pull-up part which pulls up a gate voltage to a clock signal in response to a control voltage of a control terminal (Q-node) of the pull-up part during a horizontal scanning period (1H);

a carry part which pulls up a carry voltage to the clock signal in response to the control voltage of the Q-node during the horizontal scanning period (1H), the Q-node being connected to a control electrode of the carry part;

a pull-up driving part connected to the Q-node common to the carry part and the pull-up part and which receives a previous carry voltage from a first previous stage and outputs the control voltage to the Q-node; and a ripple preventing part that includes a control electrode directly connected to the Q-node common to the carry part and the pull-up part, wherein the ripple preventing part prevents a ripple generated at a previous Q-node of a second previous stage based on a ripple generated at the Q-node of the carry part and the pull-up part.

2. The gate driving circuit of claim 1, wherein the Q-node of the carry part and the pull-up part is an i-th Q-node disposed in an i-th stage, the Q-node of the second previous stage is an (i−2)th Q-node disposed in an (i−2)-th stage, and i is a natural number greater than or equal to 3.

3. The gate driving circuit of claim 2, wherein the i-th stage further comprises a voltage input terminal to which a ground voltage is applied, and the ripple preventing part electrically connects the (i−2)-th Q-node and the voltage input terminal based on a ripple generated at the i-th Q-node to discharge a ripple generated at the (i−2)-th Q-node to the ground voltage.

4. The gate driving circuit of claim 2, wherein the i-th stage further comprises:

a holding part which holds the pull-up part and the carry part in a turn-off state; and an inverter which operates so as to perform one of turn on the holding part and turn off the holding part based on the clock signal.

5. The gate driving circuit of claim 4, wherein the holding part comprises a holding transistor comprising:

a control electrode connected to an output terminal of the inverter;

an input electrode which receives the ground voltage; and an output electrode connected to an output terminal of the pull-up driving part.

6. The gate driving circuit of claim 3, wherein the ripple preventing part comprises a ripple discharge transistor comprising:

a control electrode electrically connected to the i-th Q-node;

an input electrode electrically connected to the voltage input terminal; and an output electrode electrically connected to the (i−2)-th Q-node.

7. The gate driving circuit of claim 6, wherein the pull-up part comprises a pull-up transistor comprising:

a control electrode connected to the i-th Q-node;

an input electrode which receives the clock signal; and an output electrode which outputs the gate voltage as an i-th gate voltage, wherein a ratio of a channel width to a channel length of the ripple discharge transistor is less than a ratio of a channel width to a channel length of the pull-up transistor.

8. The gate driving circuit of claim 7, wherein the carry part comprises:

a carry transistor comprising:

a control electrode connected to the i-th Q-node;

an input electrode which receives the clock signal; and an output electrode which outputs the carry voltage; and a first capacitor connected between the control electrode and the output electrode of the carry transistor.

9. The gate driving circuit of claim 7, further comprising a pull-down part which discharges the i-th gate voltage to the ground voltage based on an (i+1)-th gate voltage from an (i+1)-th stage.

10. The gate driving circuit of claim 9, wherein the pull-down part comprises:

a first pull-down transistor comprising:

a control electrode which receives the (i+1)-th gate voltage;

an input electrode connected to the voltage input terminal; and an output electrode connected to an output terminal of the pull-up part; and a second pull-down transistor comprising:

a control electrode which receives the (i+1)-th gate voltage;

an input electrode connected to the voltage input terminal; and an output electrode connected to the i-th Q-node.

11. The gate driving circuit of claim 10, wherein a ratio of a channel width to a channel length of the second pull-down transistor is approximately equal to the ratio of the channel width to the channel length of the ripple discharge transistor.

12. The gate driving circuit of claim 8, wherein the pull-up driving part comprises:

a buffer transistor comprising:

an input electrode which receives a previous carry voltage from an (i−1)-th stage;

a control electrode which receives the previous carry voltage from the (i−1)-th stage; and an output electrode connected to the i-th Q-node; and a second capacitor connected between the control electrode and the output electrode of the pull-up transistor.

13. A display apparatus comprising:

a display part which displays an image based on a gate signal and a data signal;

a data driving circuit which applies the data signal to the display part; and a gate driving circuit comprising stages to sequentially apply the gate signal to the display part, the stages being cascaded with each other and each of the stages comprising:

a pull-up part which pulls up a gate voltage to a clock signal in response to a control voltage of a control terminal (Q-node) of the pull-up part during a horizontal scanning period (1H);

a carry part which pulls up a carry voltage to the clock in response to the control voltage of the Q-node during the horizontal scanning period (1H)), the Q-node being connected to a control electrode of the carry part;

a pull-up driving part connected to the Q-node common to the carry part and the pull-up part and which receives a previous carry voltage from a first previous stage and outputs the control voltage to the Q-node; and a ripple preventing part that includes a control electrode directly connected to the Q-node common to the carry part and the pull-up part, wherein the ripple preventing part prevents a ripple generated at a previous Q-node of a second previous stage based on a ripple generated at the Q-node of the carry part and the pull-up part.

14. The display apparatus of claim 13, wherein the Q-node of the carry part and the pull-up part is an i-th Q-node disposed in an i-th stage, the Q-node of the second previous stage is an (i−2)-th Q-node disposed in an (i−2)-th stage, and i is a natural number greater than or equal 3.

15. The display apparatus of claim 14, wherein the i-th stage further comprises a voltage input terminal to which a ground voltage is applied, and the ripple preventing part electrically connects the (i−2)-th Q-node and the voltage input terminal based on a ripple generated at the i-th Q-node to discharge a ripple generated at the (i−2)-th Q-node to the ground voltage.

16. The display apparatus of claim 15, wherein the ripple preventing part comprises a ripple discharge transistor comprising:

a control electrode electrically connected to the i-th Q-node;

an input electrode electrically connected to the voltage input terminal; and an output electrode electrically connected to the (i−2)-th Q-node.

17. A method for driving a gate driving circuit comprising cascaded stages, the method comprising:

pulling up a gate voltage to a clock signal during a horizontal scanning period (1H) using a pull-up part including a control terminal (Q-node);

pulling up a carry voltage to the clock signal during the horizontal scanning period (1H) using a carry part including a control electrode connected to the Q-node;

receiving a previous carry voltage from a first previous stage with a pull-up driving part connected to the Q-node common to the carry part and the pull-up part to turn on the pull-up part and the carry part; and preventing a ripple generated at a previous Q-node of a second previous stage based on a ripple generated at the Q-node of the carry part and the pull-up part using a ripple preventing part including a control electrode directly connected to the Q-node common to the carry part and the pull-up part.

18. The method of claim 17, wherein the Q-node of the carry part and the pull-up part is an i-th Q-node disposed in an i-th stage, the Q-node of the second previous stage is an (i−2)-th Q-node disposed in an (i−2)-th stage, and i is a natural number greater than or equal 3.

* * * * *